US005588226A

United States Patent [19]

Schenkel

[11] Patent Number: 5,588,226

[45] Date of Patent: Dec. 31, 1996

[54] UNIDIRECTIONAL AIR TRANSFER SYSTEM FOR SHOES

[76] Inventor: Décio L. Schenkel, Rua Gal. Emílio Lúcio Esteves, 1353-Taguara/RS, Brazil

[21] Appl. No.: 431,721

[22] Filed: May 1, 1995

[30] Foreign Application Priority Data

Feb. 17, 1995 [BR] Brazil ..... 9500679

[51] Int. Cl.[6] ..... A43B 7/08

[52] U.S. Cl. ..... 36/3 B; 36/3 R

[58] Field of Search ..... 36/3 B, 3 R, 3 A, 36/44, 43

[56] References Cited

U.S. PATENT DOCUMENTS

| | | | |
|---|---|---|---|
| 123,675 | 2/1872 | Bryant | 36/44 |
| 208,190 | 9/1878 | Mayer | 36/44 |
| 4,290,211 | 9/1981 | Csengeri | 36/3 B |
| 4,654,982 | 4/1987 | Lee | 36/44 X |
| 5,452,525 | 9/1995 | Miyauchi | 36/44 |

*Primary Examiner*—Ted Kavanaugh

[57] ABSTRACT

A shoe includes an assembly inner-sole and outsole with openings formed therethrough and one or more unidirectional air transfer sets disposed between the openings in the outsole and the openings in the inner-sole. The unidirectional air transfer set includes tissues separated by a breathable, waterproof membrane which permits the passage of humid or moist air in one direction only from the interior of the shoe to the exterior of the shoe to improve comfort for the user. The membrane is preferably formed of a hydrophilic polyurethane polymer.

8 Claims, 3 Drawing Sheets

UNIDIRECTIONAL AIR TRANSFER SYSTEM FOR SHOES

BACKGROUND AND SUMMARY OF THE INVENTION

The present invention is directed to shoes and, in particular, to a shoe having a unidirectional air transfer system which allows the inner air of the shoe to pass to the outer side of the shoe without letting the exterior air or liquid penetrate into the shoe.

The unidirectional air transfer system includes a set of components providing a breathable feature to the shoe, resulting in exceptional comfort for the user.

More specifically, the unidirectional air transfer system includes one or more sets of membranes, each one being positioned between two tissues, forming a "sandwich". Each set of the unidirectional air transfer system includes a central membrane having a tissue on opposite sides thereof.

Each shoe can use one or more of these sets composed of the referred to membrane and the two tissues, which may be of similar or different nature.

Generally, such sets, hereinafter referred to as unidirectional air transfer sets, tissue-membrane-tissue sets or, simply, T-M-T sets, are mounted within the shoe the shoe sole, i.e., parallel to the shoe sole and to the sole of the user's foot or foot sole, and do not occupy necessarily the whole region of the user's foot sole or the shoe sole.

Coincident with the region in the shoe where a T-M-T set is mounted, the external sole and all other sole components such as, for example, inner soles, insoles, etc., are provided with bores or openings to direct air through the T-M-T set thereby enabling air to escape from the interior of the shoe to the outside thereof.

Although the present inventive concept can be applied to any kind of shoe, the invention is being explained and described by way of a sport shoe.

The invention will be better understood as the appended drawings, represented by figures briefly described as follows, are analyzed in conjunction with the specification text.

DESCRIPTION OF THE PREFERRED EMBODIMENT

Figures 1, 4:
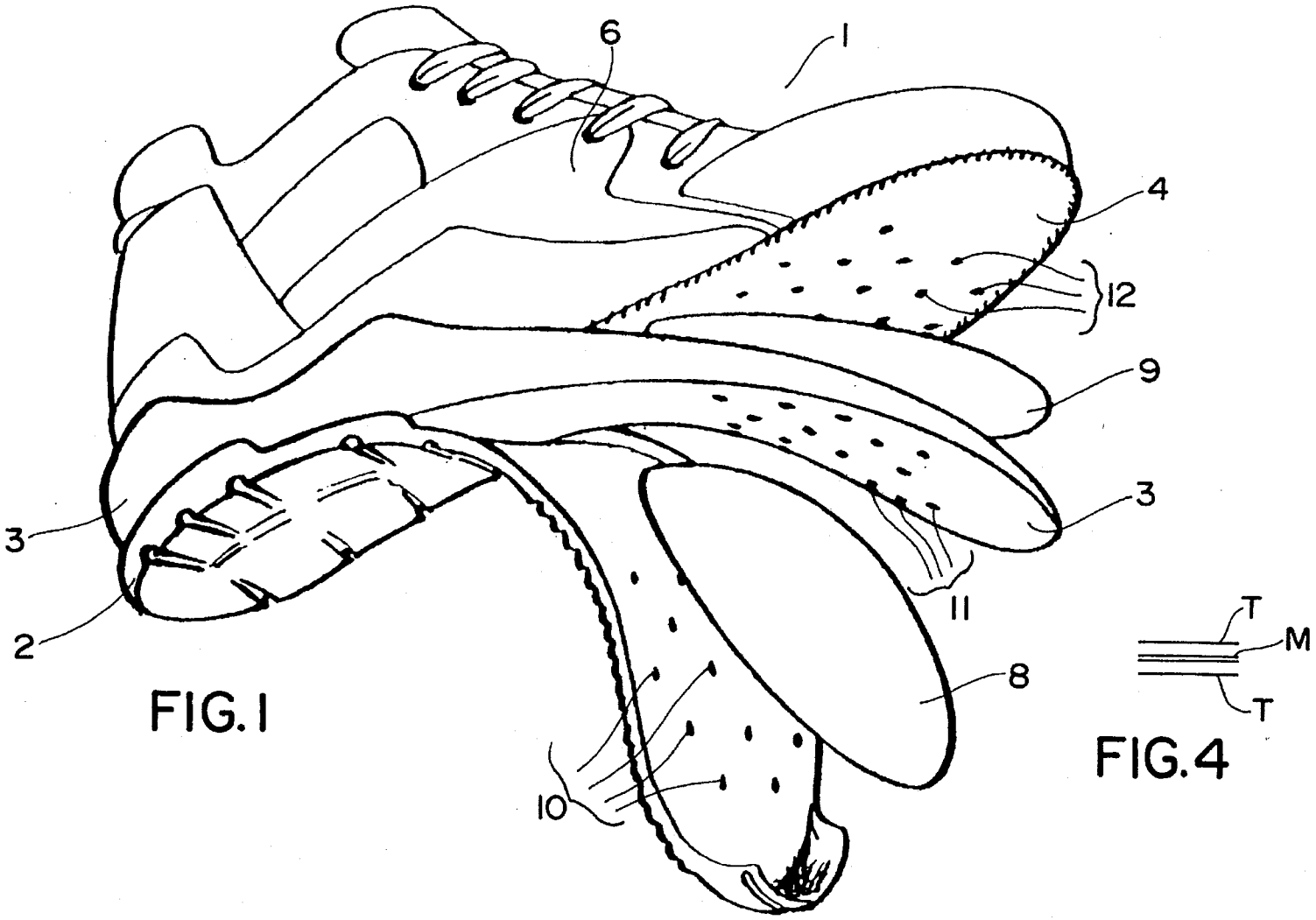
FIG. 1 is a perspective view of a shoe selected to represent the instant inventive concept, namely, a sport shoe.
FIG. 4 shows the two T-M-T sets.
Figure 2:
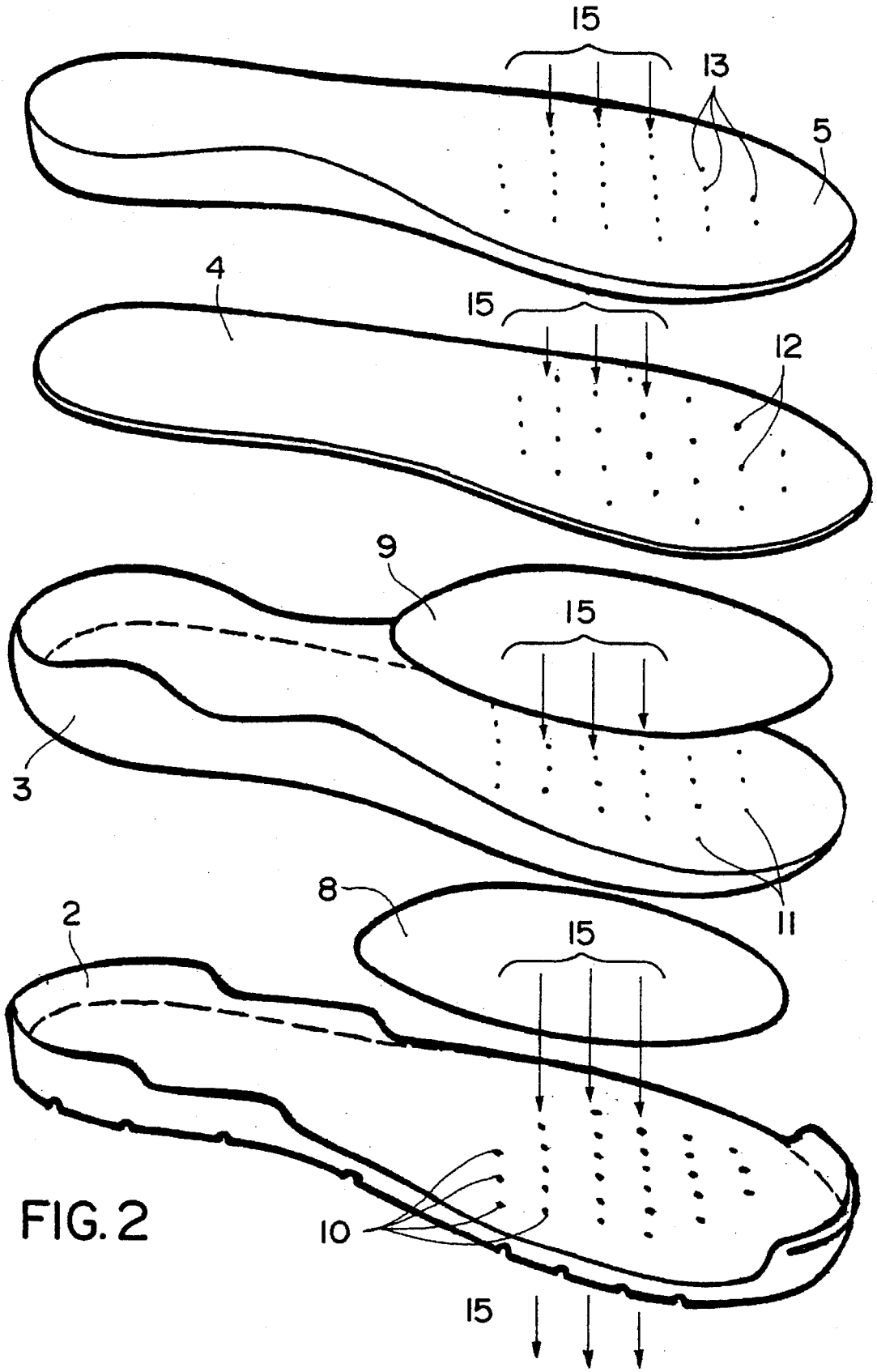
FIG. 2 is a perspective view of the sport shoe showing, separately, the various sole members according to the assembly sequence.

As shown in FIGS. 1 and 2, shoe 1 according to the present invention includes an external sole or outsole 2, a midsole 3, an assembly inner-sole 4, an in sole 5, and vamp or upper 6.

A first unidirectional air transfer set, for example T-M-T set 8 is disposed between the sole and the external midsole, and a second unidirectional air transfer set, for example T-M-T set 9, is disposed between the midsole and the assembly inner-sole 4. The inner portion of the shoe 1 further includes in -sole 5.

In order to allow air to be transferred from the interior of the shoe to the exterior thereof, through the sole components, the inventive system includes or openings bores 13 in the in and T-M-T sets 8 and 9 -sole (through which the air passes firstly), bores or openings 12 in the assembly inner-sole, bores 11 in the insole (where air can still pass), and bores or openings 10 in the external sole of the shoe, which allow the air to escape to ambient air.

The displacement of air from the interior of the shoe to the shoe Sole, and then to the exterior is shown by the arrows 15 in FIG. 2. In FIG. 2 are also shown the T-M-T sets 8 and 9 which, as unidirectional air transfer sets, allow air to pass in a direction towards the outside, of the show while avoiding or preventing moisture, water, air, etc., to penetrate into the interior of the shoe 1 through the external sole 2.

By permitting the passage of air or water in only one direction, T-M-T sets, 8 and 9 (or only one T-M-T set, or more than two T-M-T sets) form the basic inventive concept developed by the inventor.

Figure 3:
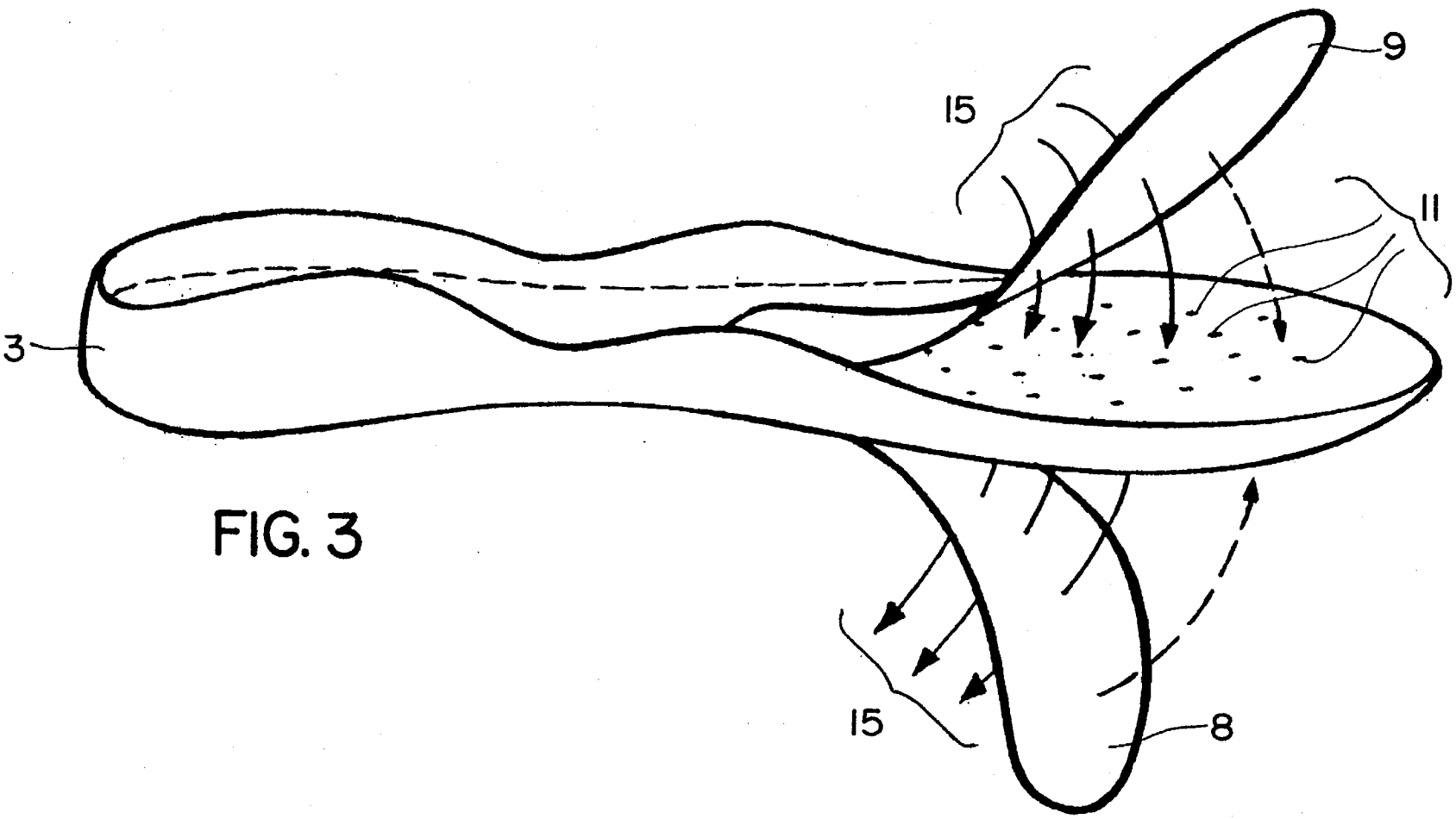
FIG. 3 is a perspective view of the insole, depicting two T-M-T (tissue-membrane-tissue) sets, one above the midsole, and another below it.

FIGS. 1–3 show each T-M-T set overlapping the bore regions which exist in the various components or assembly parts of the shoe. Thus, as shown in FIGS. 1–3, each T-M-T set 8 or 9 occupies a bore region. If it is intended to increase or decrease the air flow rate it is sufficient to increase or decrease the extent or the bore regions and the size of the T-M-T sets as well.

The thickness of the various parts or components forming the lower shoe structure, namely, external sole 2, midsole 3, assembly inner-sole 4, and in -sole 5 is not critical to the functioning of the shoe breathing or ventilating unidirectional air transfer system.

The quantity of bores 10, 11, 12 or 13 per unit surface area for each member or component 2, 3, 4 and 5 hearing the bores is a function of the shoe specification which, consequently, is also a function of the utilization of the shoe by the user.

The shape of each bore, be it in the sole 2, the most external part of the shoe, or in the remaining components 3, 4 or 5, as well as the flow rate of each bore, or of the bore sets (e.g. $cm^3/s$), is a function of each shoe specification, directed toward various utilization.

The air transfer (mainly moisture) from the interior of the shoe to the exterior, through the several components upon which the user steps, is produced by the user feet pressure proper, on the shoe, and it is the elasticity of the several sole components or support members 2, 3, 4 and 5 that pushes the air from the inside of the shoe to the outside of the shoe through the sole 2.

As best seen in FIG. 4, the T-M-T (tissue-membrane-tissue) set, an integral part of the invention, as employed at 8 and 9, comprises tissues T not necessarily specified chemically, and a membrane M placed between these tissues, this membrane having a thickness of 12 microns, and being manufactured with a hydrophilic polyurethane polymer. The polymer chemical nature and the membrane thickness provide a material with an excellent breathable property, i.e., the ability to transfer humid air.

The membrane M of the T-M-T set is an ultra thin skin that acts as ant air, water, and other liquids barrier.

Hydrophilic products are manufactured from a polymeric solid film without holes or pores, and work in the presence of water-eager molecules by the polymeric chain, which cause water vapor molecules to pass one another and through the whole skin thickness.

Although the invention has been described by way of a sport shoe, and shown with two T-M-T sets, it is obvious that: (a) the instant system can be applied to any sort of shoe; (b) the number of T-M-T sets may vary in accordance to the technical circumstances; (c) the bore arrangement pattern, shape and dimensions can be altered regarding specification; and (d) remaining features depicted in the drawings can also be modified in the course of each application to industrial applicability, all such alterations being within the legal protection established by the claims.

I claim:

1. A shoe comprising an outsole with openings formed therethrough;

an assembly inner-sole with openings formed therethrough; and a unidirectional air transfer set disposed between said outsole and said inner-sole and including tissues separated by a breathable membrane permitting passage of humid air in one direction only, said unidirectional air transfer set being interposed between said openings in said inner-sole and said openings in said outer-sole to permit humid air to pass through said breathable membrane and tissues in one direction only from an interior of said shoe to an exterior of said shoe.

2. A shoe as recited in claim 1 and further comprising a midsole with openings formed therethrough, said midsole being disposed between said outsole and said inner-sole with said unidirectional air transfer set being disposed between said midsole and one of said outsole and said inner-sole.

3. A shoe as recited in claim 2 wherein said unidirectional air transfer set is disposed between said midsole and said outsole, and further comprising a second unidirectional air transfer set disposed between said midsole and said inner-sole.

4. A shoe as recited in claim 1 and further comprising an insole with openings formed therethrough, said insole being disposed in the interior of said shoe adjacent said inner-sole.

5. A shoe as recited in claim 1 wherein said unidirectional air transfer set occupies a portion of the region between said inner-sole and said outsole and wherein said openings in said inner-sole and said outsole occupy a region similar in size to the region occupied by said unidirectional air transfer set.

6. A shoe as recited in claim 1 wherein said breathable membrane is formed of a hydrophilic polyurethane polymer.

7. A shoe as recited in claim 6 wherein said hydrophilic polyurethane polymer membrane allows water vapor molecules to pass therethrough in one direction only.

8. A shoe as recited in claim 6 wherein said hydrophilic polyurethane polymer membrane has a thickness of 12 microns.

* * * * *